US007699121B2

(12) United States Patent
Juhasz et al.

(10) Patent No.: US 7,699,121 B2
(45) Date of Patent: Apr. 20, 2010

(54) PIPE RUNNING TOOL HAVING A PRIMARY LOAD PATH

(75) Inventors: Daniel Juhasz, Westminster, CA (US); George Boyadjieff, Villa Park, CA (US); Brian L. Eidem, Cerritos, CA (US); Pamela Eidem, legal representative, Cerritos, CA (US); Hans van Rijzingen, Etten-Leur (NL); Herman M. Kamphorst, Assen (NL); Hans Joachim Dietrich Böttger, Den Helder (NL); Gustaaf Louis van Wechem, Reeuwijk (NL); David Mason, Anaheim Hills, CA (US); Anton Krijnen, Klundert (NL)

(73) Assignee: Varco I/P, Inc., Orange, CA (US)

( * ) Notice: Subject to any disclaimer, the term of this patent is extended or adjusted under 35 U.S.C. 154(b) by 53 days.

(21) Appl. No.: 11/165,661

(22) Filed: Jun. 24, 2005

(65) Prior Publication Data

US 2006/0124293 A1 Jun. 15, 2006

Related U.S. Application Data

(63) Continuation-in-part of application No. 11/040,453, filed on Jan. 20, 2005, now Pat. No. 7,096,977, which is a continuation of application No. 10/189,355, filed on Jul. 3, 2002, now Pat. No. 6,938,709, which is a continuation of application No. 09/518,122, filed on Mar. 3, 2000, now Pat. No. 6,443,241.

(60) Provisional application No. 60/122,915, filed on Mar. 5, 1999.

(51) Int. Cl.
*E21B 19/22* (2006.01)

(52) U.S. Cl. ..... 175/52; 175/85; 166/77.53

(58) Field of Classification Search ..... 175/52, 175/85, 162; 166/77.51, 77.52, 77.53, 85.1
See application file for complete search history.

(56) References Cited

U.S. PATENT DOCUMENTS 2,488,107 A 11/1949 Abegg (Continued)

FOREIGN PATENT DOCUMENTS

EP 0285385 A2 10/1988

(Continued)

OTHER PUBLICATIONS

International Search Report relating to corresponding parent International Application No. PCT/US00/05752 dated Sep. 28, 2000.

(Continued)

*Primary Examiner*—William P Neuder
(74) *Attorney, Agent, or Firm*—Christie, Parker & Hale, LLP

(57) ABSTRACT

A system for coupling a pipe segment to a pipe string is provided that includes a top drive assembly having a threaded output shaft; and a pipe running tool threadingly coupled to the threaded output shaft of the top drive assembly such that the primary load of the pipe running tool is supported by the threads of the output shaft of the top drive assembly, and wherein the pipe running tool is rotatable by the output shaft and further includes a pipe engaging portion for grippingly engaging the pipe segment sufficient to transmit a torque from the top drive output shaft to the pipe segment.

15 Claims, 8 Drawing Sheets

U.S. PATENT DOCUMENTS

| | | | | |
|---|---|---|---|---|
| 2,863,638 | A | | 12/1958 | Thornburg |
| 3,193,116 | A | | 7/1965 | Kenneday et al. |
| 3,301,334 | A | | 1/1967 | Odgers Et Al. |
| 3,706,347 | A | | 12/1972 | Brown |
| 3,708,020 | A | | 1/1973 | Adamson |
| 3,747,675 | A | | 7/1973 | Brown |
| 3,766,991 | A | | 10/1973 | Brown |
| 3,780,883 | A | | 12/1973 | Brown |
| 3,915,244 | A | | 10/1975 | Brown |
| 4,100,968 | A | | 7/1978 | Delano |
| 4,190,119 | A | | 2/1980 | Loftis et al. |
| 4,274,778 | A | | 6/1981 | Putnam et al. |
| 4,403,897 | A | | 9/1983 | Willis |
| 4,449,596 | A | | 5/1984 | Boyadjieff |
| 4,529,045 | A | | 7/1985 | Boyadjieff et al. |
| 4,535,852 | A | | 8/1985 | Boyadjieff et al. |
| 4,570,706 | A | | 2/1986 | Pugnet |
| 4,593,773 | A | | 6/1986 | Skeie |
| 4,605,077 | A | | 8/1986 | Boyadjieff |
| 4,709,766 | A | | 12/1987 | Boyadjieff |
| 4,715,451 | A | | 12/1987 | Bseisu et al. |
| 4,781,359 | A | | 11/1988 | Matus |
| 4,791,997 | A | | 12/1988 | Krasnov |
| 4,997,042 | A | | 3/1991 | Jordan et al. |
| 5,039,927 | A | | 8/1991 | Centafanti |
| 5,107,940 | A | | 4/1992 | Berry |
| 5,191,939 | A | | 3/1993 | Stokley |
| 5,255,751 | A | * | 10/1993 | Stogner ..... 175/203 |
| 5,294,228 | A | | 3/1994 | Willis et al. |
| 5,297,833 | A | * | 3/1994 | Willis et al. ..... 294/102.2 |
| 5,351,767 | A | * | 10/1994 | Stogner et al. ..... 175/162 |
| 5,584,343 | A | | 12/1996 | Coone |
| 5,735,348 | A | | 4/1998 | Hawkins, III |
| 5,785,132 | A | | 7/1998 | Richardson et al. |
| 5,839,330 | A | | 11/1998 | Stokka |
| 5,918,673 | A | | 7/1999 | Hawkins et al. |
| 5,971,079 | A | | 10/1999 | Mullins |
| 6,068,066 | A | | 5/2000 | Byrt et al. |
| 6,142,545 | A | * | 11/2000 | Penman et al. ..... 294/86.15 |
| 6,276,450 | B1 | | 8/2001 | Seneviratne |
| 6,279,654 | B1 | | 8/2001 | Mosing et al. |
| 6,431,626 | B1 | | 8/2002 | Bouligny |
| 6,443,241 | B1 | | 9/2002 | Juhasz et al. |
| 6,527,493 | B1 | | 3/2003 | Kamphorst et al. |
| 6,799,638 | B2 | | 10/2004 | Butterfield, Jr. |
| 6,938,709 | B2 | | 9/2005 | Juhasz et al. |
| 7,059,427 | B2 | | 6/2006 | Power et al. |
| 2002/0170720 | A1 | | 11/2002 | Haugen |
| 2003/0066654 | A1 | | 4/2003 | Juhasz et al. |
| 2006/0005962 | A1 | | 1/2006 | Juhasz et al. |
| 2007/0074876 | A1 | * | 4/2007 | Pietras ..... 166/379 |

FOREIGN PATENT DOCUMENTS

| | | | |
|---|---|---|---|
| EP | 0311455 | A1 | 4/1989 |
| EP | 0525247 | | 2/1993 |
| EP | 1 619 349 | A2 | 1/2006 |
| EP | 1171683 | B1 | 9/2007 |
| WO | WO 92/11486 | | 7/1992 |
| WO | WO 93/07358 | | 4/1993 |
| WO | WO 96/18799 | | 6/1996 |
| WO | WO 98/11322 | | 3/1998 |
| WO | WO 99/30000 | | 6/1999 |
| WO | WO 00/52297 | | 9/2000 |
| WO | WO 03/038229 | A2 | 5/2003 |

OTHER PUBLICATIONS

Kamphorst et al., Casing Running Tool; SPE/IADC 52770; pp. 1-9.
International Search Report for corresponding International Application No. PCT/US06/22438 dated Sep. 25, 2007, 3pp.
Written Opinion for corresponding International Application No. PCT/US06/22438 dated Sep. 25, 2007, 3pp.
Complaint in CV05-0634A; Pleading; Apr. 11, 2005; 8pp.; W. Dist. Louisiana.
Plaintiffs First Amended Complaint in CV05-0634A; Pleading; Oct. 3, 2005; 7pp.; W. Dist. Louisiana; Alexandria, Louisiana.
Order Granting Motion to Transfer in CV05-0634A; Order; Jul. 19, 2006; 2pp.; W. Dist. Louisiana; Alexandria, Louisiana.
Complaint in H-05-2118; Pleading; Jun. 17, 2005; 7pp.; S. Dist. Texas; Houston, Texas.
First Amended Complaint in CV-05-2118; Pleading; Jun. 23, 2005; 6pp.; S. Dist. Texas; Houston, Texas.
Second Amended Complaint in CV-05-2118; Pleading; Sep. 6, 2005; 6pp.; S. Dist. Texas; Houston, Texas.
Stipulated Protective Order in CV-05-2118; Order; Dec. 5, 2005; 12pp.; S. Dist. Texas; Houston, Texas.
Notice of Opposition in EP 1,171,683 B1; Opposition Document filed in EPO; Apr. 1, 2008; 162pp.; European Patent Office; Europe.
Request for Inter Partes Reexamination of USPN 6,938,709; Reexamination Request filed in USPTO; Oct. 4, 2006; 115pp.; United States Patent and Trademark Office; Alexandria, Virginia.
Request for Inter Partes Reexamination of USPN 7,096,977; Reexamination Request filed in USPTO; Sep. 21, 2006; 123pp.; United States Patent and Trademark Office; Alexandria, Virginia.
Response to Opposition against European Patent No. EP 1,171,683; Reply Document filed in EPO; Jan. 20, 2009; European Patent Office; Europe.

* cited by examiner

PIPE RUNNING TOOL HAVING A PRIMARY LOAD PATH

CROSS-REFERENCE TO RELATED APPLICATION(S)

This application is a continuation-in-part of U.S. patent application Ser. No. 11/040,453, filed on Jan. 20, 2005, issued as U.S. Pat. No. 7,096,977, which is a continuation of U.S. patent application Ser. No. 10/189,355, filed on Jul. 3, 2002, issued as U.S. Pat. No. 6,938,709, which is a continuation of U.S. patent application Ser. No. 09/518,122, filed Mar. 3, 2000, issued as U.S. Pat. No. 6,443,241, which claims priority under 35 U.S.C. § 119(e) to U.S. Provisional Patent Application No. 60/122,915, filed on Mar. 5, 1999.

BACKGROUND OF THE INVENTION

1. Field of the Invention

This invention relates to well drilling operations and, more particularly, to a device for assisting in the assembly of pipe strings, such as casing strings, drill strings and the like.

2. Description of the Related Art

The drilling of oil wells involves assembling drill strings and casing strings, each of which comprises a plurality of elongated, heavy pipe segments extending downwardly from an oil drilling rig into a hole. The drill string consists of a number of sections of pipe which are threadedly engaged together, with the lowest segment (i.e., the one extending the furthest into the hole) carrying a drill bit at its lower end. Typically, the casing string is provided around the drill string to line the well bore after drilling the hole and to ensure the integrity of the hole. The casing string also consists of a plurality of pipe segments which are threadedly coupled together and formed with internal diameters sized to receive the drill string and/or other pipe strings.

The conventional manner in which plural casing segments are coupled together to form a casing string is a labor-intensive method involving the use of a "stabber" and casing tongs. The stabber is manually controlled to insert a segment of casing into the upper end of the existing casing string, and the tongs are designed to engage and rotate the segment to threadedly connect it to the casing string. While such a method is effective, it is cumbersome and relatively inefficient because the procedure is done manually. In addition, the casing tongs require a casing crew to properly engage the segment of casing and to couple the segment to the casing string. Thus, such a method is relatively labor-intensive and therefore costly. Furthermore, using casing tongs requires the setting up of scaffolding or other like structures, and is therefore inefficient.

Accordingly, it will be apparent to those skilled in the art that there continues to be a need for a device for use in a drilling system which utilizes an existing top drive assembly to efficiently assemble pipe strings, and which positively engages a pipe segment to ensure proper coupling of the pipe segment to a pipe string. A need also exists for a pipe running tool that is more compact than known tools. The present invention addresses these needs and others.

SUMMARY OF THE INVENTION

In one embodiment, the present invention is a system for coupling a pipe segment to a pipe string that includes a top drive assembly having a threaded output shaft; and a pipe running tool threadingly coupled to the threaded output shaft of the top drive assembly such that the primary load of the pipe running tool is supported by the threads of the output shaft of the top drive assembly, and wherein the pipe running tool is rotatable by the output shaft and further includes a pipe engaging portion for grippingly engaging the pipe segment sufficient to transmit a torque from the top drive output shaft to the pipe segment.

Other features and advantages of the present invention will become apparent from the following detailed description, taken in conjunction with the accompanying drawings which illustrate, by way of example, the features of the present invention.

DETAILED DESCRIPTION OF THE PREFERRED EMBODIMENTS

As shown in FIGS. 1-11, the present invention is directed to a pipe running tool for use in drilling systems and the like to threadingly connect pipe segments to pipe strings (as used hereinafter, the term pipe segment shall be understood to refer to casing segments and/or drill segments, while the term pipe string shall be understood to refer to casing strings and/or drill strings.)

The pipe running tool according to the present invention engages a pipe segment and is further coupled to an existing top drive assembly, such that a rotation of the top drive assembly imparts a torque on the pipe segment during a threading operation between the pipe segment and a pipe string. In one embodiment, the pipe running tool includes a load compensator which controls the load that the threads of the pipe segment apply to the threads of the pipe string during a threading operation.

In one embodiment, the pipe running tool includes a primary load path, wherein the primary load of the pipe running tool and any pipe segments and/or pipe strings is supported by the threads on an output shaft of a top drive assembly. This allows the pipe running tool to be a more streamlined and compact tool.

Figure 1:
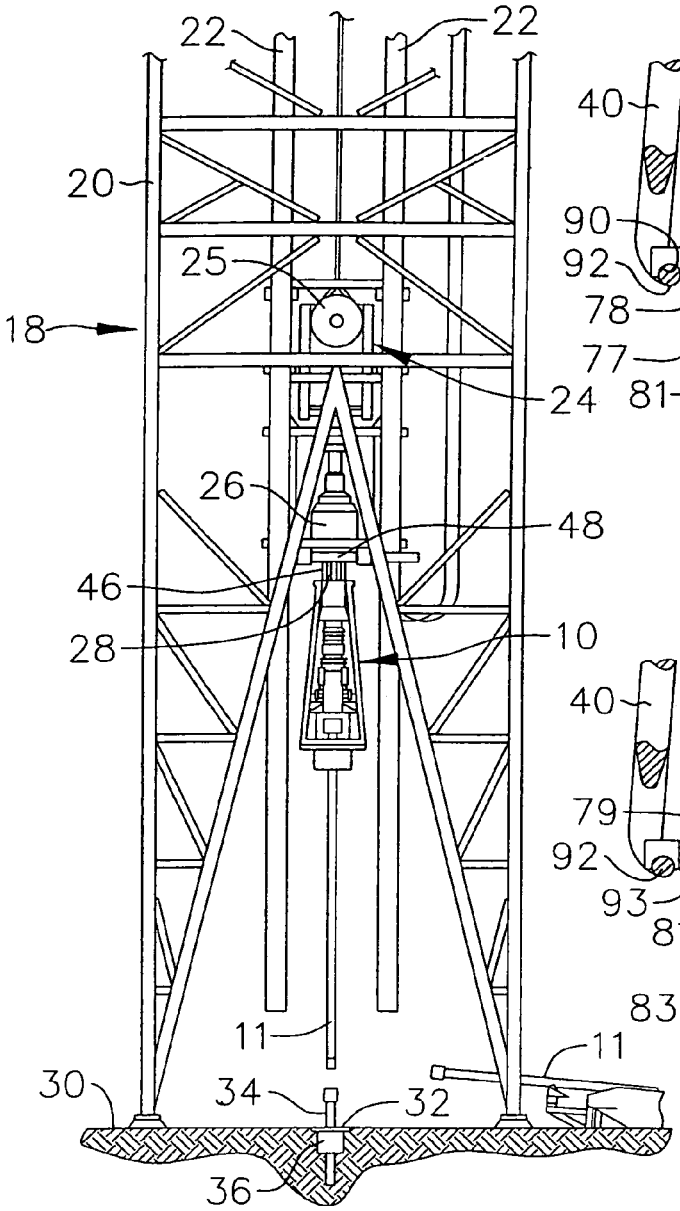
FIG. 1 is an elevated side view of a drilling rig incorporating a pipe running tool according to one illustrative embodiment of the present invention.
Figure 2:
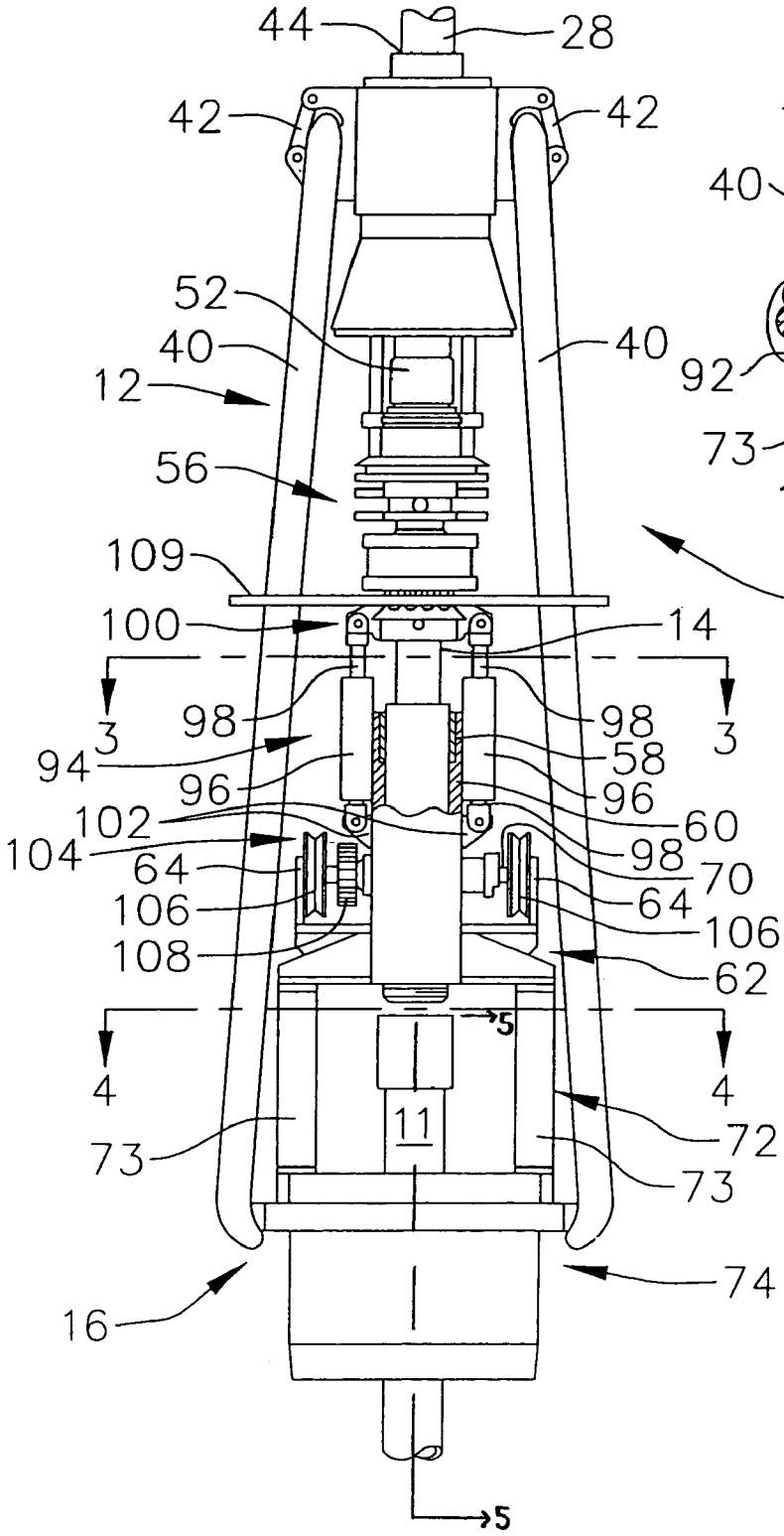
FIG. 2 is a side view, in enlarged scale, of the pipe running tool of FIG. 1.
Figure 4:
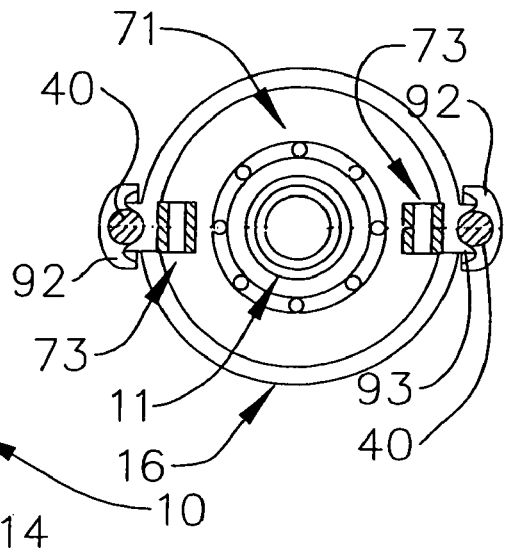
FIG. 4 is a cross-sectional view taken along the line 4-4 of FIG. 2.
Figure 3:
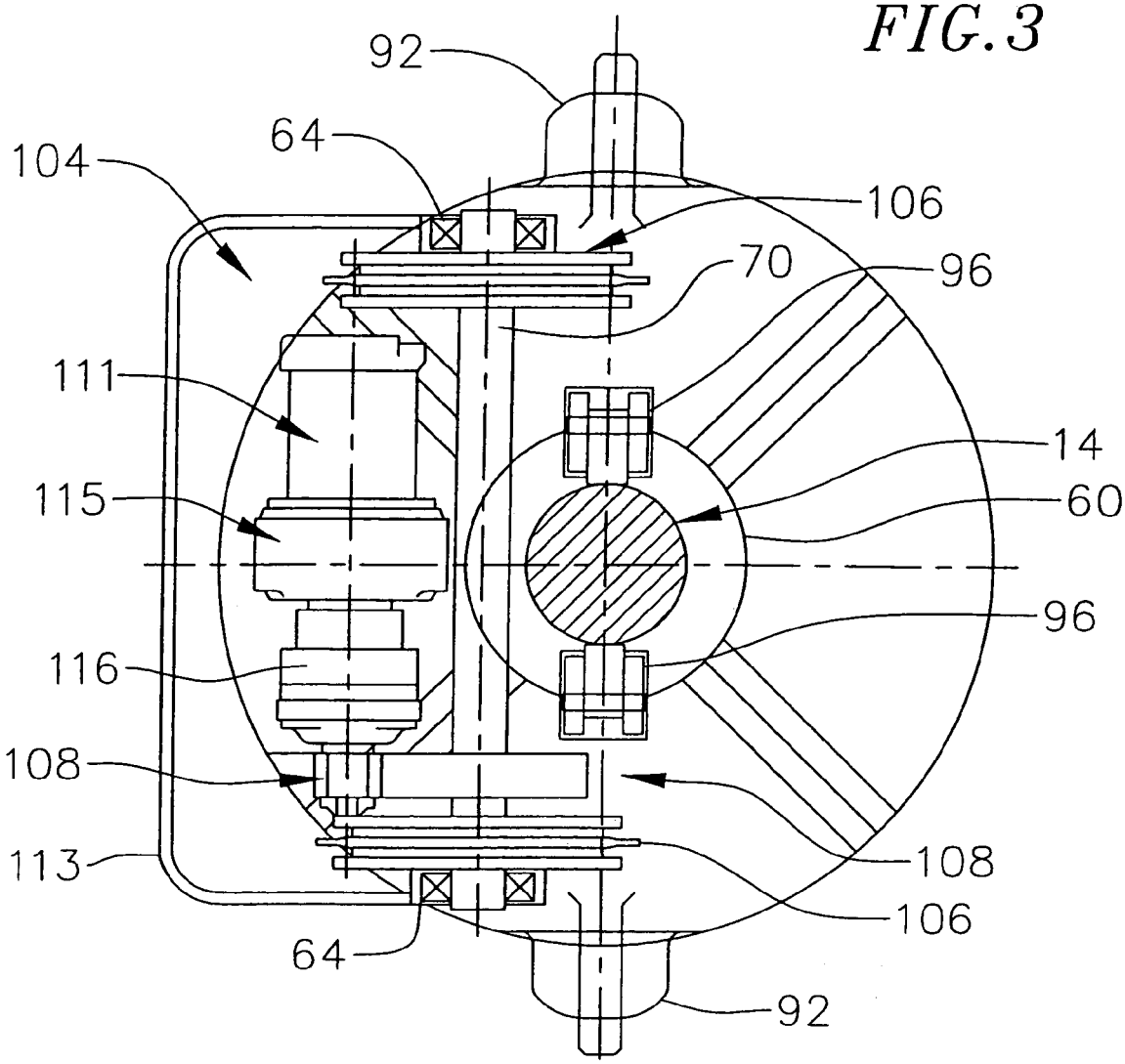
FIG. 3 is a cross-sectional view taken along the line 3-3 of FIG. 2.

In the following detailed description, like reference numerals will be used to refer to like or corresponding elements in the different figures of the drawings. Referring now to FIGS. 1 and 2, there is shown a pipe running tool 10 depicting one illustrative embodiment of the present invention, which is designed for use in assembling pipe strings, such as drill strings, casing strings, and the like. As shown for example in FIG. 2, the pipe running tool 10 comprises, generally, a frame assembly 12, a rotatable shaft 14, and a pipe engagement assembly 16, which is coupled to the rotatable shaft 14 for rotation therewith. The pipe engagement assembly 16 is designed for selective engagement of a pipe segment 11 (as shown for example in FIGS. 1,2, and 5A) to substantially prevent relative rotation between the pipe segment 11 and the pipe engagement assembly 16. As shown for example in FIG. 1, the rotatable shaft 14 is designed for coupling with a top drive output shaft 28 from an existing top drive 24, such that the top drive 24, which is normally used to rotate a drill string to drill a well hole, may be used to assemble a pipe segment 11 to a pipe string 34, as is described in greater detail below.

As show, for example, in FIG. 1, the pipe running tool 10 may be designed for use in a well drilling rig 18. A suitable example of such a rig is disclosed in U.S. Pat. No. 4,765,401 to Boyadjieff, which is expressly incorporated herein by reference as if fully set forth herein. As shown in FIG. 1, the well drilling rig 18 includes a frame 20 and a pair of guide rails 22 along which a top drive assembly, generally designated 24, may ride for vertical movement relative to the well drilling rig 18. The top drive assembly 24 is preferably a conventional top drive used to rotate a drill string to drill a well hole, as is described in U.S. Pat. No. 4,605,077 to Boyadjieff, which is expressly incorporated herein by reference. The top drive assembly 24 includes a drive motor 26 and a top drive output shaft 28 extending downwardly from the drive motor 26, with the drive motor 26 being operative to rotate the drive output shaft 28, as is conventional in the art. The well drilling rig 18 defines a drill floor 30 having a central opening 32 through which pipe string 34, such as a drill string and/or casing string, is extended downwardly into a well hole.

The rig 18 also includes a flush-mounted spider 36 that is configured to releasably engage the pipe string 34 and support the weight thereof as it extends downwardly from the spider 36 into the well hole. As is well known in the art, the spider 36 includes a generally cylindrical housing which defines a central passageway through which the pipe string 34 may pass. The spider 36 includes a plurality of slips which are located within the housing and are selectively displaceable between disengaged and engaged positions, with the slips being driven radially inwardly to the respective engaged position to tightly engage the pipe string 34 and thereby prevent relative movement or rotation of the pipe string 34 with respect to the spider housing. The slips are preferably driven between the disengaged and engaged positions by means of a hydraulic or pneumatic system, but may be driven by any other suitable means.

Referring primarily to FIG. 2, the pipe running tool 10 includes the frame assembly 12, which comprises a pair of links 40 extending downwardly from a link adapter 42. The link adapter 42 defines a central opening 44 through which the top drive output shaft 28 may pass. Mounted to the link adapter 42 on diametrically opposed sides of the central opening 44 are respective upwardly extending, tubular members 46 (FIG. 1), which are spaced a predetermined distance apart to allow the top drive output shaft 28 to pass therebetween. The respective tubular members 46 connect at their upper ends to a rotating head 48, which is connected to the top drive assembly 24 for movement therewith. The rotating head 48 defines a central opening (not shown) through which the top drive output shaft 28 may pass, and also includes a bearing (not shown) which engages the upper ends of the tubular members 46 and permits the tubular members 46 to rotate relative to the rotating head body, as is described in greater detail below.

The top drive output shaft 28 terminates at its lower end in an internally splined coupler 52 which is engaged to an upper end (not shown) of the rotatable shaft 14 of the pipe running tool 10. In one embodiment, the upper end of the rotatable shaft 14 of the pipe running tool 10 is formed to complement the splined coupler 52 for rotation therewith. Thus, when the top drive output shaft 28 is rotated by the top drive motor 26, the rotatable shaft 14 of the pipe running tool 10 is also rotated. It will be understood that any suitable interface may be used to securely engage the top drive output shaft 28 with the rotatable shaft 14 of the pipe running tool 10.

In one illustrative embodiment, the rotatable shaft 14 of the pipe running tool 10 is connected to a conventional pipe handler, generally designated 56, which may be engaged by a suitable torque wrench (not shown) to rotate rotatable shaft 14 and thereby make and break threaded connections that require very high torque, as is well known in the art.

In one embodiment, the rotatable shaft 14 of the pipe running tool is also formed with a lower splined segment 58, which is slidably received in an elongated, splined bushing 60 which serves as an extension of the rotatable shaft 14 of the pipe running tool 10. The rotatable shaft 14 and the bushing 60 are splined to provide for vertical movement of the rotatable shaft 14 relative to the bushing 60, as is described in greater detail below. It will be understood that the splined interface causes the bushing 60 to rotate when the rotatable shaft 14 of the pipe running tool 10 rotates.

The pipe running tool 10 further includes the pipe engagement assembly 16, which in one embodiment comprises a torque transfer sleeve 62 (as shown for example in FIG. 2), which is securely connected to a lower end of the bushing 60 for rotation therewith. The torque transfer sleeve 62 is generally annular and includes a pair of upwardly projecting arms 64 on diametrically opposed sides of the sleeve 62. The arms 64 are formed with respective horizontal through passageways (not shown) into which are mounted respective bearings (not shown) which serve to journal a rotatable axle 70 therein, as described in greater detail below. The torque transfer sleeve 62 connects at its lower end to a downwardly extending torque frame 72 in the form of a pair of tubular members 73, which in turn is coupled to a spider\elevator 74 which rotates with the torque frame 72. It will be apparent that the torque frame 72 may have any one of a variety of structures, such as a plurality of tubular members, a solid body, or any other suitable structure.

Figure 5A:
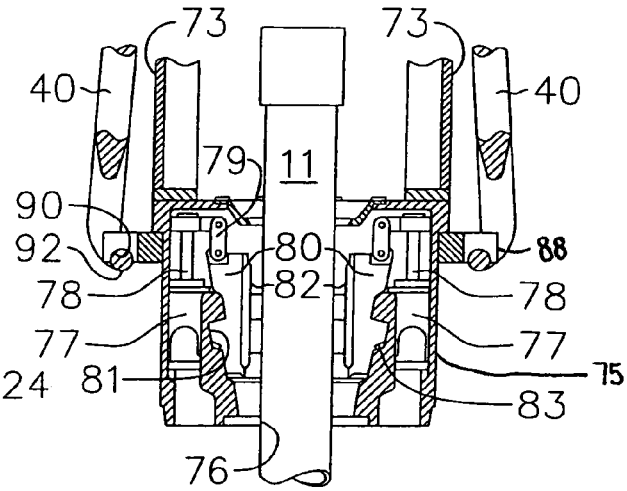
FIG. 5A is a cross-sectional view taken along the line 5-5 of FIG. 2 and showing a spider\elevator in a disengaged position.
Figure 5B:
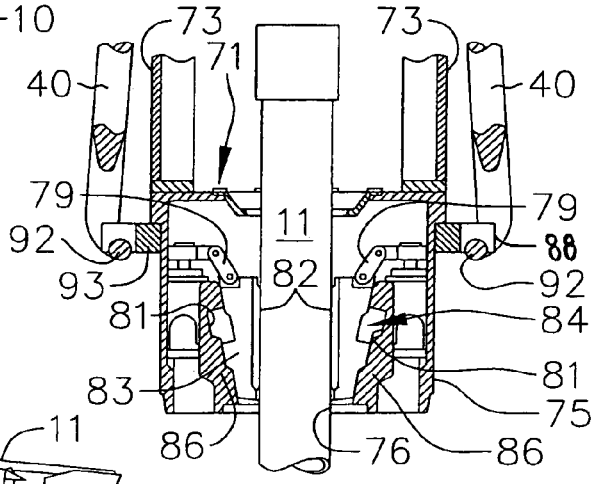
FIG. 5B is a cross-sectional view similar to FIG. 5A and showing the spider\elevator in an engaged position.

The spider\elevator 74 is preferably powered by a hydraulic or pneumatic system, or alternatively by an electric drive motor or any other suitable powered system. As shown in FIGS. 5A and 5B, the spider\elevator includes a housing 75 which defines a central passageway 76 through which the pipe segment 11 may pass. The spider\elevator 74 also includes a pair of hydraulic or pneumatic cylinders 77 with displaceable piston rods 78, which are connected through suitable pivotable linkages 79 to respective slips 80. The linkages 79 are pivotally connected to both the top ends of the piston rods 78 and the top ends of the slips 80. The slips 80 include generally planar front gripping surfaces 82, and specially contoured rear surfaces 84 which are designed with such a contour to cause the slips 80 to travel between respective radially outwardly disposed, disengaged positions, and radially inwardly disposed, engaged positions. The rear surfaces of the slips 80 travel along respective downwardly and radially inwardly projecting guiding members 86 which are complementarily contoured and securely connected to the spider body. The guiding members 86 cooperate with the cylinders 77 and linkages 79 to cam the slips 80 radially inwardly and force the slips 80 into the respective engaged positions. Thus, the cylinders 77 (or other actuating means) may be empowered to drive the piston rods 78 downwardly, causing the corresponding linkages 79 to be driven downwardly and therefore force the slips 80 downwardly. The surfaces of the guiding members 86 are angled to force the slips 80 radially inwardly as they are driven downwardly to sandwich the pipe segment 11 between them, with the guiding members 86 maintaining the slips 80 in tight engagement with the pipe segment 11.

To disengage the pipe segment 11 from the slips 80, the cylinders 77 are operated in reverse to drive the piston rods 78 upwardly, which draws the linkages 79 upwardly and retracts the respective slips 80 back to their disengaged positions to release the pipe segment 11. The guiding members 86 are preferably formed with respective notches 81 which receive respective projecting portions 83 of the slips 80 to lock the slips 80 in the disengaged position (FIG. 5A).

The spider\elevator 74 further includes a pair of diametrically opposed, outwardly projecting ears 88 formed with downwardly facing recesses 90 sized to receive correspondingly formed, cylindrical members 92 at a bottom end of the respective links 40, and thereby securely connect the lower ends of the links 40 to the spider\elevator 74. The ears 88 maybe connected to an annular sleeve 93 which is received over the spider housing 75. Alternatively, the ears may be integrally formed with the spider housing.

In one illustrative embodiment, the pipe running tool 10 includes a load compensator, generally designated 94. In one embodiment, the load compensator 94 is in the form of a pair of hydraulic, double rodded cylinders 96, each of which includes a pair of piston rods 98 that are selectively extendable from, and retractable into, the cylinders 96. Upper ends of the rods 98 connect to a compensator clamp 100, which in turn is connected to the rotatable shaft 14 of the pipe running tool 10, while lower ends of the rods 98 extend downwardly and connect to a pair of ears 102 which are securely mounted to the bushing 60. The hydraulic cylinders 96 may be actuated to draw the bushing 60 upwardly relative to the rotatable shaft 14 of the pipe running tool 10 by applying a pressure to the cylinders 96 which causes the upper ends of the piston rods 98 to retract into the respective cylinder bodies 96, with the splined interface between the bushing 60 and the lower splined section 58 of the rotatable shaft 14 allowing the bushing 60 to be displaced vertically relative to the rotatable shaft 14. In that manner, the pipe segment 11 carried by the spider\elevator 74 may be raised vertically to relieve a portion or all of the load applied by the threads of the pipe segment 11 to the threads of the pipe string 34, as is described in greater detail below.

As is shown in FIG. 2, the lower ends of the rods 98 are at least partially retracted, resulting in the majority of the load from the pipe running tool 10 being assumed by the top drive output shaft 28. In addition, when a load above a pre-selected maximum is applied to the pipe segment 11, the cylinders 96 will automatically retract the load to prevent the entire load from being applied to the threads of the pipe string 11.

In one embodiment, the pipe running tool 10 still further includes a hoist mechanism, generally designated 104, for hoisting a pipe segment 11 upwardly into the spider\elevator 74. In the embodiment of FIG. 2, the hoist mechanism 104 is disposed off-axis and includes a pair of pulleys 106 carried by the axle 70, the axle 70 being journaled into the bearings in respective through passageways formed in the arms 64. The hoist mechanism 104 also includes a gear drive, generally designated 108, that may be selectively driven by a hydraulic motor 111 or other suitable drive system to rotate the axle 70 and thus the pulleys 106. The hoist may also include a brake 115 to prevent rotation of the axle 70 and therefore of the pulleys 106 and lock them in place, as well as a torque hub 116. Therefore, a pair of chains, cables, or other suitable, flexible means may be run over the respective pulleys 106, extended through a chain well 113, and engaged to the pipe segment 11. The axle 70 is then rotated by a suitable drive system to hoist the pipe segment 11 vertically and up into position with the upper end of the pipe segment 11 extending into the spider\elevator 74.

In one embodiment, as shown in FIG. 1, the pipe running tool 10 further includes an annular collar 109 which is received over the links 40 and which maintains the links 40 locked to the ears 88 of the spider\elevator 74 and prevents the links 40 from twisting and/or winding.

In use, a work crew may manipulate the pipe running tool 10 until the upper end of the tool 10 is aligned with the lower end of the top drive output shaft 28. The pipe running tool 10 is then raised vertically until the splined coupler 52 at the lower end of the top drive output shaft 28 is engaged to the upper end of the rotatable shaft 14 of the pipe running tool 10 and the links 40 of the pipe running tool 10 are engaged with the ears 88 of the spider\elevator 74 . The work crew may then run a pair of chains or cables over the respective pulleys 106 of the hoist mechanism 104, connect the chains or cables to a pipe segment 11, engage a suitable drive system to the gear 108, and actuate the drive system to rotate the pulleys 106 and thereby hoist the pipe segment 11 upwardly until the upper end of the pipe segment 11 extends through the lower end of the spider\elevator 74. The spider\elevator 74 is then actuated, with the hydraulic cylinders 77 and guiding members 86 cooperating to forcibly drive the respective slips 80 into the engaged positions (FIG. 5B) to positively engage the pipe segment 11. The slips 80 are preferably advanced to a sufficient extent to prevent relative rotation between the pipe segment 11 and the spider\elevator 74, such that rotation of the spider\elevator 74 translates into a corresponding rotation of the pipe segment 11, allowing for a threaded engagement of the pipe segment 11 to the pipe string 34.

The top drive assembly 24 is then lowered relative to the rig frame 20 by means of a top hoist 25 to drive the threaded lower end of the pipe segment 11 into contact with the threaded upper end of the pipe string 34 (FIG. 1). As shown in FIG. 1, the pipe string 34 is securely held in place by means of the flush-mounted spider 36 or any other suitable structure for securing the string 34 in place, as is well known to those skilled in the art. Once the threads of the pipe segment 11 are properly mated with the threads of the pipe string 34, the top drive motor 26 is actuated to rotate the top drive output shaft 28, which in turn rotates the rotatable shaft 14 of the pipe running tool 10 and the spider\elevator 74. This in turn causes the coupled pipe segment 11 to rotate to threadingly engage the pipe string 34.

In one embodiment, the pipe segment 11 is intentionally lowered until the lower end of the pipe segment 11 rests on top of the pipe string 34. The load compensator 94 is then actuated to drive the bushing 60 upwardly relative to the rotatable shaft 14 of the pipe running tool 10 via the splined interface between the bushing 60 and the rotatable shaft 14. The upward movement of the bushing 60 causes the spider\elevator 74 and therefore the coupled pipe segment 11 to be raised, thereby reducing the load that the threads of the pipe segment 11 apply to the threads of the pipe string 34. In this manner, the load on the threads can be controlled by actuating the load compensator 94.

Once the pipe segment 11 is threadedly coupled to the pipe string 34, the top drive assembly 24 is raised vertically to lift the entire pipe string 34, which causes the flush-mounted spider 36 to disengage the pipe string 34. The top drive assembly 24 is then lowered to advance the pipe string 34 downwardly into the well hole until the upper end of the top pipe segment 11 is close to the drill floor 30, with the entire load of the pipe string 11 being carried by the links 40 while the torque was supplied through shafts. The flush-mounted spider 36 is then actuated to engage the pipe string 11 and suspend it therefrom. The spider\elevator 74 is then controlled in reverse to retract the slips 80 back to the respective disengaged positions (FIG. 5A) to release the pipe string 11. The top drive assembly 24 is then raised to lift the pipe running tool 10 up to a starting position (such as that shown in FIG. 1) and the process may be repeated with an additional pipe segment 11.

Figure 6:
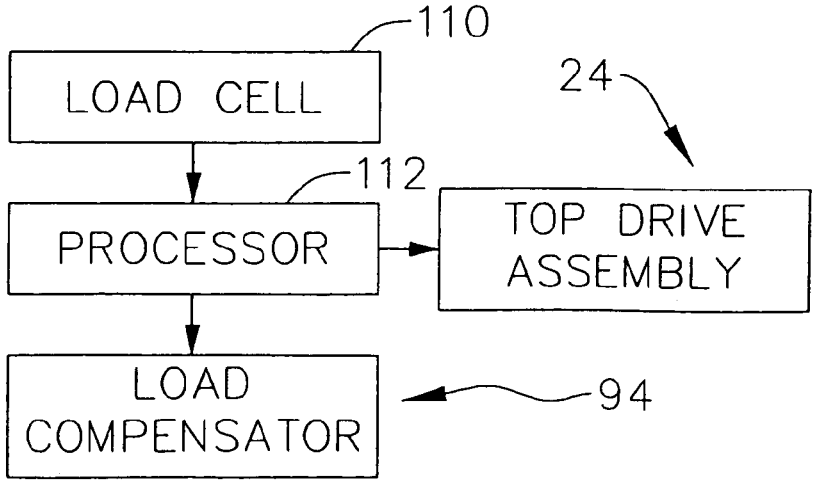
FIG. 6 is a block diagram of components included in one illustrative embodiment of the invention.

Referring to FIG. 6, there is shown a block diagram of components included in one illustrative embodiment of the pipe running tool 10. In this embodiment, the tool includes a conventional load cell 110 or other suitable load-measuring device mounted on the pipe running tool 10 in such a manner that it is in communication with the rotatable shaft 14 of the pipe running tool 10 to determine the load applied to the lower end of the pipe segment 11. The load cell 110 is operative to generate a signal representing the load sensed, which in one illustrative embodiment is transmitted to a processor 112. The processor 112 is programmed with a predetermined threshold load value, and compares the signal from the load cell 110 with the predetermined threshold load value. If the load exceeds the predetermined threshold value, the processor 112 activates the load compensator 94 to draw the pipe running tool 10 upwardly a selected amount to relieve at least a portion of the load on the threads of the pipe segment 11. Once the load is at or below the predetermined threshold value, the processor 112 controls the top drive assembly 24 to rotate the pipe segment 11 and thereby threadedly engage the pipe segment 11 to the pipe string 34. While the top drive assembly 24 is actuated, the processor 112 continues to monitor the signals from the load cell 110 to ensure that the load on the pipe segment 11 does not exceed the predetermined threshold value.

Alternatively, the load on the pipe segment 11 may be controlled manually, with the load cell 110 indicating the load on the pipe segment 11 via a suitable gauge or other display, with a work person controlling the load compensator 94 and top drive assembly 24 accordingly.

Figure 7:
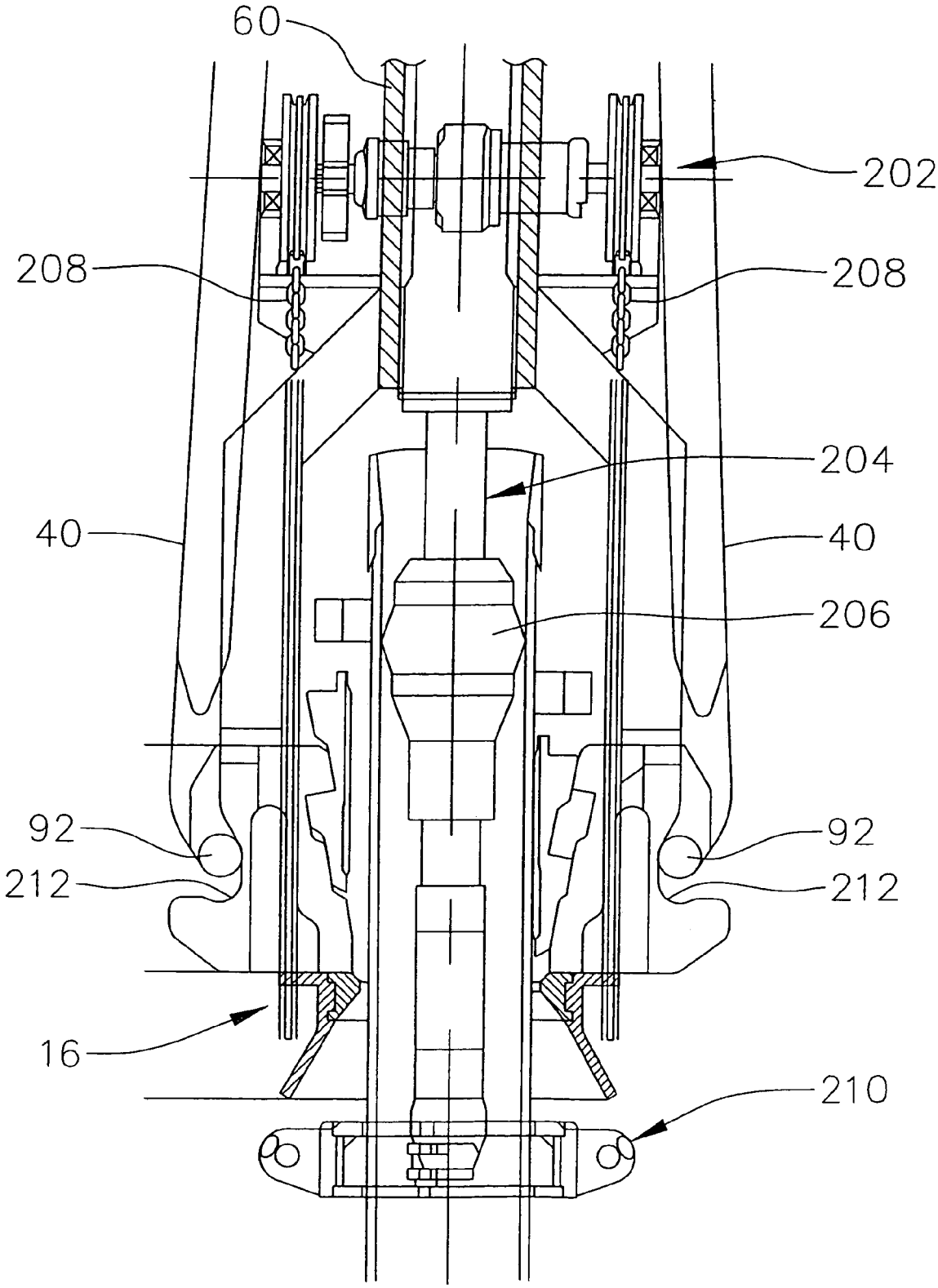
FIG. 7 is a side view of another illustrative embodiment of the invention.

Referring to FIG. 7, there is shown another preferred embodiment of the pipe running tool 200 of the present invention. The pipe running tool includes a hoisting mechanism 202 which is substantially the same as the hoisting mechanism 104 described above. A rotatable shaft 204 is provided that is connected at its lower end to a conventional mud-filling device 206 which, as is known in the art, is used to fill a pipe segment 11, for example, a casing segment, with mud during the assembly process. In one illustrative embodiment, the mud-filling device is a device manufactured by Davies-Lynch Inc. of Texas.

The hoisting mechanism 202 supports a pair of chains 208 which engage a slip-type single joint elevator 210 at the lower end of the pipe running tool 200. As is known in the art, the single joint elevator is operative to releasably engage a pipe segment 11, with the hoisting mechanism 202 being operative to raise the single joint elevator and the pipe segment 11 upwardly and into the spider\elevator 74.

The tool 200 includes links 40 which define the cylindrical lower ends 92 which are received in generally J-shaped cutouts 212 formed in diametrically opposite sides of the spider\elevator 74.

From the foregoing, it will be apparent that the pipe running tool 10 efficiently utilizes an existing top drive assembly 24 to assemble a pipe string 11, for example, a casing or drill string, and does not rely on cumbersome casing tongs and other conventional devices. The pipe running tool 10 incorporates the spider\elevator 74, which not only carries pipe segments 11, but also imparts rotation to them to threadedly engage the pipe segments 11 to an existing pipe string 34. Thus, the pipe running tool 10 provides a device which grips and torques the pipe segment 11, and which also is capable of supporting the entire load of the pipe string 34 as it is lowered down into the well hole.

In the embodiment of FIGS. 1-7, the pipe running tool 10 is connected to a stem of the top drive assembly 24 and the weight of the pipe running tool 10 and any pipe segments 11 and/or pipe strings 34 attached thereto is transferred from an upper end of the pipe running tool 10 through the link adapters 42 to the links 40, which extend substantially along an overall vertical length of the pipe running tool 10.

Figure 8:
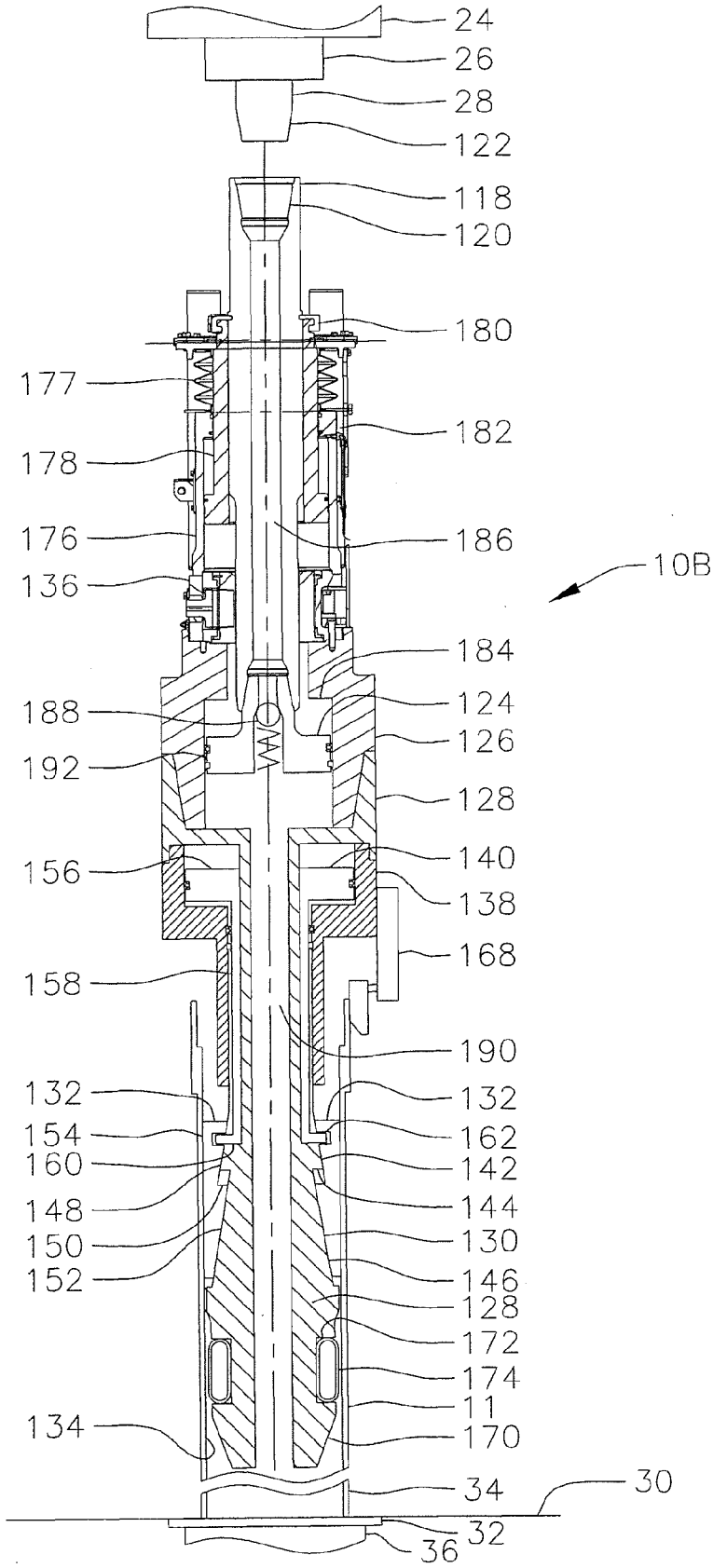
FIG. 8 is a cross-sectional view of a pipe running tool according to one embodiment of the invention, with a top drive assembly shown schematically.

FIG. 8 shows a pipe running tool 10B according to another embodiment of the invention. In this embodiment, a primary load path is provided wherein the primary load of the pipe running tool 10B and any pipe segments 11 and/or pipe strings 34 is supported by the threads 122 on the output shaft 28 of the top drive assembly 24. This allows the pipe running tool 10B to be a more streamlined and compact tool.

In one embodiment, as shown in FIG. 8, an upper end of the a pipe running tool 10B includes a top drive extension shaft 118 having internal threads 120 which threadably engage external threads 122 on the output shaft 28 of the top drive assembly 24. As such, a rotation of the output shaft 28 of the top drive assembly 24 is directly transferred to the top drive extension shaft 118 of the pipe running tool 10B. Although not show, one or more internal blowout preventers, such as an upper internal blowout preventer and a lower internal blowout preventer maybe threadably engaged between the threads 122 of the output shaft 28 of the top drive assembly 24 and the threads 120 of the top drive extension shaft 118. Note that in another embodiment, the top drive extension shaft 118 may be externally threaded and the output shaft 28 of the top drive assembly 24 may be internally threaded.

Attached to a lower end of the top drive extension shaft 118 is a lift cylinder 124, which is disposed within a lift cylinder housing 126. The lift cylinder housing 126, in turn, is attached, such as by a threaded connection, to a stinger body 128. The stinger body 128 includes a slip cone section 130, which slidably receives a plurality of slips 132, such that when the stinger body 128 is placed within a pipe segment 11, the slips 132 may be slid along the slip cone section 130 between engaged and disengaged positions with respect to an internal diameter 134 of the pipe segment 11. The slips 132 are may driven between the engaged and disengaged positions by means of a hydraulic, pneumatic, or electrical system, among other suitable means.

In one embodiment, a lower end of the top drive extension shaft 118 is externally splined allowing for a vertical movement, but not a rotationally movement, of the extension shaft 118 with respect to an internally splined ring 136, within which the splined lower end of the top drive extension shaft 118 is received. The splined ring 136 is further non-rotatably attached to the lift cylinder housing 126. As such, a rotation of the top drive assembly 24 is transmitted from the output shaft 28 of the top drive assembly 24 to the top drive extension shaft 118, which transmits the rotation to the splined ring 136 through the splined connection of the extension shaft 118 and the splined ring 136. The splined ring 136, in turn, transmits the rotation to the lift cylinder housing 126, which transmits the rotation to the stinger body 128, such that when the slips 132 of the stinger body 128 are engaged with a pipe segment 11, the rotation or torque of the top drive assembly 24 is transmitted to the pipe segment 11, allowing for a threaded engagement of the pipe segment 11 with a pipe string 34.

In one embodiment, the pipe running tool 10B includes a slip cylinder housing 138 attached, such as by a threaded connection, to an upper portion of the stinger body 128. Disposed within the slip cylinder housing 138 is a slip cylinder 140. In one embodiment, the pipe running tool 10B includes one slip cylinder 140, which is connected to each of the plurality of slips 132, such that vertical movements of the slip cylinder 140 cause each of the plurality of slips 132 to move between the engaged and disengaged positions with respect to the pipe segment 11.

Vertical movements of the slip cylinder 140 maybe accomplished by use of a compressed air or a hydraulic fluid acting of the slip cylinder 140 within the slip cylinder housing 138. Alternatively, vertical movements of the slip cylinder 140 may be controlled electronically. In one embodiment, a lower end of the slip cylinder 140 is connected to a plurality of slips 132, such that vertical movements of the slip cylinder 140 cause each of the plurality of slips 132 to slide along the slip cone section 130 of the stinger body 128.

As shown, an outer surface of the slip cone section 130 of the stinger body 128 is tapered. For example, in this embodiment the slip cone section 130 is tapered radially outwardly in the downward direction and each of the plurality of slips 132 include an inner surface that is correspondingly tapered radially outwardly in the downward direction. In one embodiment, the slip cone section 130 includes a first tapered section 142 and a second tapered section 146 separated by a radially inward step 144; and each of the plurality of slips 132 includes a includes a first tapered section 148 and a second tapered section 152 separated by a radially inward step 150. The inward steps 144 and 150 of the slip cone section 130 and the slips 132, respectively, allow each of the plurality of slips 132 to have a desirable length in the vertical direction without creating an undesirably small cross sectional area at the smallest portion of the slip cone section 130. An elongated length of the slips 132 is desirable as it increases the contact area between the outer surface of the slips 132 and the internal diameter of the pipe segment 11.

In one embodiment, when the slip cylinder 140 is disposed in a powered down position, the slips 132 are slid down the slip cone section 130 of the stinger body 128 and radially outwardly into an engaged position with the internal diameter 134 of the pipe segment 11; and when the slip cylinder 140 is disposed in an upward position, the slips 132 are slid up the slip cone section 130 of the stinger body 128 and radially inwardly to a disengaged position with the internal diameter 134 of the pipe segment 11.

In one embodiment, each of the slips 132 includes a generally planar front gripping surface 154, which includes a gripping means, such as teeth, for engaging the internal diameter 134 of the pipe segment 11. In one embodiment, the slip cylinder 140 is provided with a powered down force actuating the slip cylinder 140 into the powered down position with sufficient force to enable a transfer of torque from the top drive assembly 24 to the pipe segment 11 through the slips 132.

Figure 9:
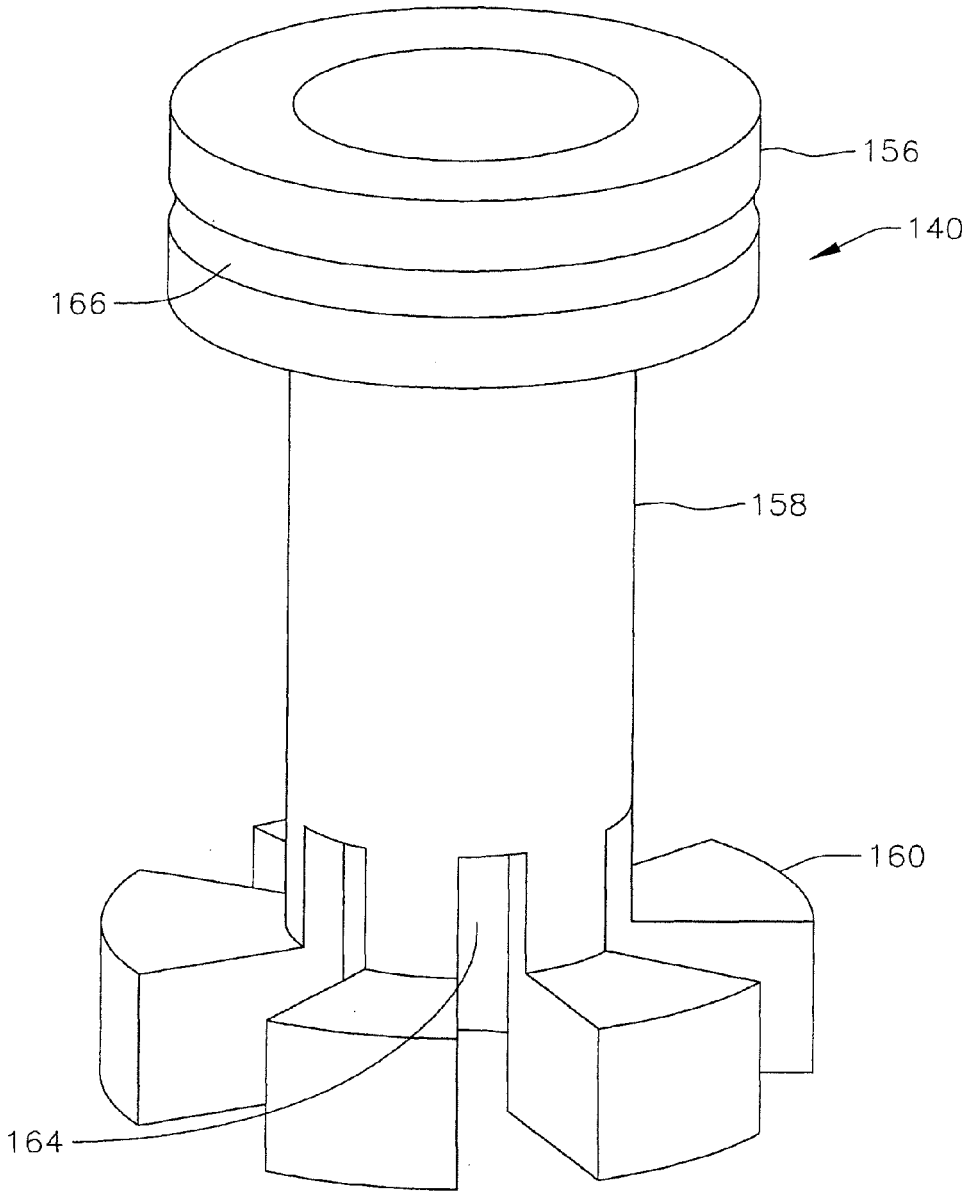
FIG. 9 is a perspective view of a slip cylinder for use in the pipe running tool of FIG. 8.

FIG. 9 shows one embodiment of a slip cylinder 140 for use with the pipe running tool 10B of FIG. 8. As shown, the slip cylinder 140 includes a head 156 and a shaft 158, wherein the shaft 158 includes a plurality of feet 160 each for attaching to a notch 162 in a corresponding one of the plurality of slips 132 (see also FIG. 8.) A slot 164 may extend between each of the plurality of feet 160 of the slip cylinder 140 to add flexibility to the feet 160 to facilitate attachment of the feet 160 to the corresponding slips 132. The head 156 of the slip cylinder 140 may also include a circumferential groove 166 for receiving a sealing element, such as an o-ring, to seal the hydraulic fluid or compressed gas above and below the slip cylinder head 156. In various embodiments the plurality of slips 132 may include three, four, six or any appropriate number of slips 132.

As shown in FIG. 8, attached to the slip cylinder housing 138 is a pipe segment detector 168. In one embodiment, upon detection by the pipe detector 168 of a pipe segment being placed adjacent to the pipe detector 168, the pipe detector 168 activates the slip cylinder 140 to the powered down position, moving the slips 132 into engagement with the pipe segment 11, allowing the pipe segment 11 to be translated and/or rotated by the top drive assembly 24.

As is also shown in FIG. 8, a lower end of the stinger body 128 includes a stabbing cone 170, which is tapered radially outwardly in the upward direction. This taper facilitates insertion of the stinger body 128 into the pipe segment 11. Adjacent to the stabbing cone 170 is a circumferential groove 172, which receives an inflatable packer 174. In one embodiment, there are two operational options for the packer 174. For example, the packer 174 can be used in either a deflated or an inflated state during a pipe/casing run. When filling up the casing/pipe string with mud/drilling fluid, it is advantageous to have the packer 174 in the deflated state in order to enable a vent of air out of the casing. This is called the fill-up mode. When mud needs to be circulated through the whole casing string at high pressure and high flow, it is advantageous to have the packer 174 in the inflated state to seal off the internal volume of the casing. This is called the circulation mode.

In one embodiment, an outer diameter of the inflatable packer 174 in the deflated state is larger that the largest cross-sectional area of the cone 170. This helps channel any drilling fluid which flows toward the cone 170 to an underside of the inflatable packer 174, such that during the circulation mode, the pressure on the underside of the inflatable packer 174 causes the packer 174 to inflate and form a seal against the internal diameter of the pipe segment 11. This seal prevents drilling fluid from contacting the slips 132 and/or the slip cone section 130 of the stinger body 128, which could lessen the grip of the slips 132 on the internal diameter 134 of the pipe segment 11.

In an embodiment where the a pipe running tool includes an external gripper, such as that shown in FIG. 2, a packer may be disposed above the slips. By controlling how far the pipe is pushed up through the slips prior to setting these slips, it is controlled whether the packer is inserted in the casing (circulation mode) or still above the casing (fill-up mode) when the slips are set. For this reason, such a pipe running tool may include a pipe position sensor which is capable of detecting 2 independent pipe positions.

Referring now to an upper portion of the pipe running tool 10B, attached to an upper portion of the splined ring 136 is a compensator housing 176. Disposed above the compensator housing 176 is a spring package 177. A load compensator 178 is disposed within the compensator housing 176 and is attached at its upper end to the top drive extension shaft 118 by a connector or "keeper" 180. The load compensator 178 is vertically movable within the compensator housing 176. With the load compensator 178 attached to the top drive extension shaft 118 in a non-vertically movable manner, and with the extension shaft 118 connected to the stinger body 128 via a splined connection, a vertical movement of the load compensator 178 causes a relative vertical movement between the top drive extension shaft 118 and the stinger body 128, and hence a relative vertical movement between the top drive assembly 24 and the pipe segment 11 when the stinger body 128 is engaged with a pipe segment 11.

Relative vertical movement between the pipe segment 11 and the top drive assembly 24 serves several functions. For example, in one embodiment, when the pipe segment 11 is threaded into the pipe sting 34, the pipe string 34 is held vertically and rotationally motionless by action of the flush-mounted spider 36. Thus, as the pipe segment 11 is threaded into the pipe string 34, the pipe segment 11 is moved downwardly. By allowing relative vertical movement between the top drive assembly 24 and the pipe segment 11, the top drive assembly 24 does not need to be moved vertically during a threading operation between the pipe segment 11 and the pipe sting 34. Also, allowing relative vertical movement between the top drive assembly 24 and the pipe segment 11 allows the load that threads of the pipe segment 11 apply to the threads of the pipe string 34 to be controlled or compensated.

As with the slip cylinder 140, vertical movements of the load compensator 178 may be accomplished by use of a compressed air or a hydraulic fluid acting of the load compensator 178, or by electronic control, among other appropriate means. In one embodiment, the load compensator 178 is an air cushioned compensator. In this embodiment, air is inserted into the compensator housing 176 via a hose 182 and acts downwardly on the load compensator 178 at a predetermined force. This moves the pipe segment 11 upwardly by a predetermined amount and lessens the load on the threads of the pipe segment 11 by a predetermined amount, thus controlling the load on the threads of the pipe segment 11 by a predetermined amount.

Alternatively, a load cell (not shown) may be used to measure the load on the threads of the pipe segment 11. A processor (not shown) may be provided with a predetermined threshold load and programmed to activate the load compensator 178 to lessen the load on the threads of the pipe segment 11 when the load cell detects a load that exceeds the predetermined threshold value of the processor, similar to that described above with respect to FIG. 6.

As shown in FIG. 8, the lift cylinder housing 126 includes a load shoulder 184. Since the lift cylinder 124 is designed to be vertically moveable with the load compensator 178, during a threading operation between the pipe segment 11 and the pipe string 34, the lift cylinder 124 is designed to be free from the load shoulder 184, allowing the load compensator 178 to control the load on the threads of the pipe segment 11, and allowing for movement of the pipe segment 11 relative to the top drive assembly 24. However, when it is desired to lift the pipe segment 11 and/or the pipe string 34, the lift cylinder 124 is moved vertically upward by the top drive assembly 24 into contact with the load shoulder 184. The weight of the pipe running tool 10B and any pipes held thereby is then supported by the interaction of the lift cylinder 124 and the load shoulder 184. As such, the pipe running tool 10B is able to transfer both torque and hoist loads to the pipe segment 11.

As shown in FIG. 8, the top drive extended shaft 118 includes a drilling fluid passageway 186 which leads to a drilling fluid valve 188 in the lift cylinder 124. The drilling fluid passageway 186 in the extended shaft 118 and the drilling fluid valve 188 in the lift cylinder 124 allow drilling fluid to flow internally past the splined connection of the spline ring 136 and the splined section of the extension shaft 118, and therefore does not interfere with or "gumm up" this splined connection. The lift cylinder 124 also includes a circumferential groove 192 for receiving a sealing element, such as an o-ring, to provide a seal preventing drilling fluid from flowing upwardly therepast, thus further protecting the splined connection. Below the drilling fluid valve 188 in the lift cylinder 124, the drilling fluid is directed through a drilling fluid passageway 190 in the stinger body 128, through the internal diameters of the pipe segment 11 and the pipe sting 34 and down the well bore. In one embodiment, the pipe segment 11 is a casing segment having a diameter of at least fourteen inches.

As can be seen from the illustration of FIG. 8 and the above description related thereto, in this embodiment a primary load path is provided wherein the primary load of the pipe running tool 10B and any pipe segments 11 and/or pipe strings 34 is supported by, i.e. hangs directly from the threads 122 on the output shaft 28 of the top drive assembly 24. This allows the pipe running tool 10B to be a more streamlined and compact tool.

Figure 10:
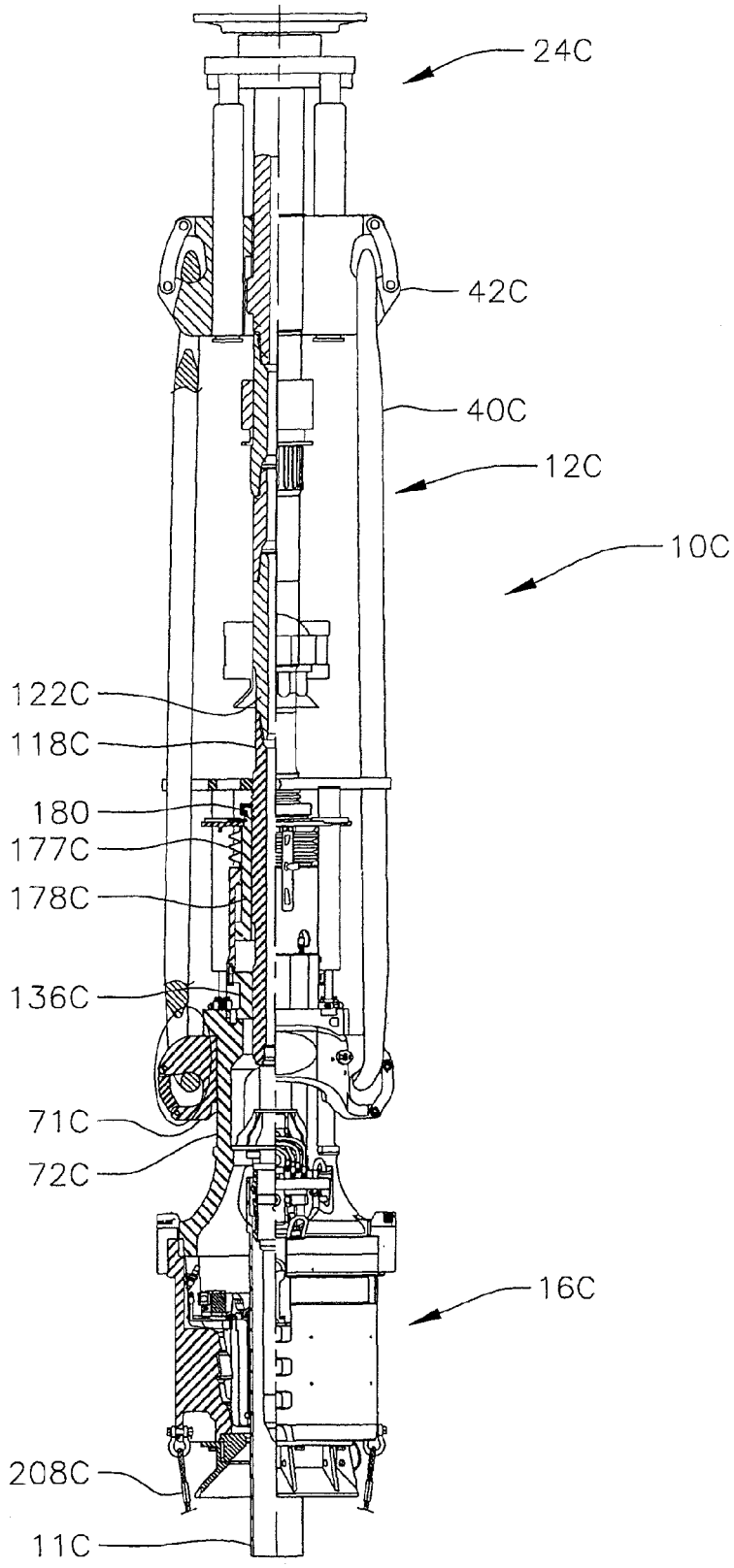
FIG. 10 is a side view, shown partially in cross-section, of a pipe running tool according to another embodiment of the invention.

FIG. 10 shows a pipe running tool 10C having an external gripping pipe engagement assembly 16C for gripping the external diameter of a pipe segment 11 C, and a load compensator 178C. The external gripping pipe engagement assembly 16C of FIG. 10 includes substantially the same elements and functions as described above with respect to the pipe engagement assembly 16 of FIGS. 2-5B and therefore will not be described herein to avoid duplicity, except where explicitly stated below.

The embodiment of FIG. 10 shows a top drive assembly 24C having an output shaft 122C connected to a top drive extension shaft 118C on the pipe running tool 10C. A lower end of the top drive extension shaft 118C is externally splined allowing for a vertical movement, but not a rotationally movement, of the extension shaft 118C with respect to an internally splined ring 136C, within which the splined lower end of the top drive extension shaft 118C is received.

The load compensator 178C is connected to the top drive extension shaft 118C by a keeper 180C. The load compensator 178 is disposed within and is vertically moveable with respect to a load compensator housing 176. The load compensator housing 176 is connected to the splined ring 136C, which is further connected to an upper portion of the pipe engagement assembly 16C. Disposed above the load compensator housing 176C is a spring package 177C.

With the load compensator 178C attached to the top drive extension shaft 11 8C in a non- vertically movable manner, and with the extension shaft 118C connected to the pipe engagement assembly 16C via a splined connection (i.e., the splined ring 136C), a vertical movement of the load compensator 178C causes a relative vertical movement between the top drive extension shaft 118C and the pipe engagement assembly 16C, and hence a relative vertical movement between the top drive assembly 24C and the pipe segment 11C when the pipe engagement assembly 16C is engaged with a pipe segment 11C.

Vertical movements of the load compensator 178C may be accomplished by use of a compressed air or a hydraulic fluid acting of the load compensator 178C, or by electronic control, among other appropriate means. In one embodiment, the load compensator 178C is an air cushioned compensator. In this embodiment, air is inserted into the compensator housing 176C via a hose and acts downwardly on the load compensator 178C at a predetermined force. This moves the pipe segment 11C upwardly by a predetermined amount and lessens the load on the threads of the pipe segment 11C by a predetermined amount, thus controlling the load on the threads of the pipe segment 11C by a predetermined amount.

Alternatively, a load cell (not shown) may be used to measure the load on the threads of the pipe segment 11C. A processor (not shown) may be provided with a predetermined threshold load and programmed to activate the load compensator 178C to lessen the load on the threads of the pipe segment 11C when the load cell detects a load that exceeds the predetermined threshold value of the processor, similar to that described above with respect to FIG. 6.

The pipe running tool according to one embodiment of the invention, may be equipped with the hoisting mechanism 202 and chains 208 to move a single joint elevator 210 that is disposed below the pipe running tool as described above with respect to FIG. 7. Alternatively, a set of wire ropes/slings may be attached to a bottom portion of the pipe running tool for the same purpose, such as is shown in FIG. 10.

As is also shown in FIG. 10, the pipe running tool 10C includes the frame assembly 12C, which comprises a pair of links 40C extending downwardly from a link adapter 42C. The links 40C are connected to and supported at their lower ends by a hoist ring 71C. The hoist ring 71C is slidably connected to a torque frame 72C. From the position depicted in FIG. 10, a top surface of the hoist rig 71C contacts an external load shoulder on the torque frame 72C. As such, the hoist ring 71C performs a similar function as the lift cylinder 192 described above with respect to FIG. 8. When the compensator 178C is disposed at an intermediate stroke position, such as a mid-stoke position, the top surface of the hoist ring 71C is displaced downwards from the position shown in FIG. 10, free form the external load shoulder of the torque frame 72C, thus allowing the compensator 178C to compensate.

In one embodiment, when an entire pipe string is to be lifted, the compensator 178C bottoms out and the external load shoulder of the torque frame 72C rests on the top surface of the hoist ring 71C. In one embodiment, the link adapter 42C, the links 40C and the hoist ring 71C are axially fixed to the output shaft 122C of the top drive assembly 24C. As such, when the external load shoulder on the torque frame 72C rests on the hoist ring 71C, the compensator 178C cannot axially move and as such cannot compensate. Therefore, in one embodiment, during the make-up of a pipe segment to a pipe string, the compensator 178C lifts the torque frame 72C and the top drive extension shaft 11 8C on the pipe running tool 10C upwardly until the compensator 178C is at an intermediate position, such as a mid-stroke position. During this movement, the torque frame 72C is axially free from the hoist ring 71C. Although not shown, the pipe engagement assembly 16 of FIGS. 2-5B may be attached to its links 40 in the manner as shown in FIG. 10.

Figure 11:
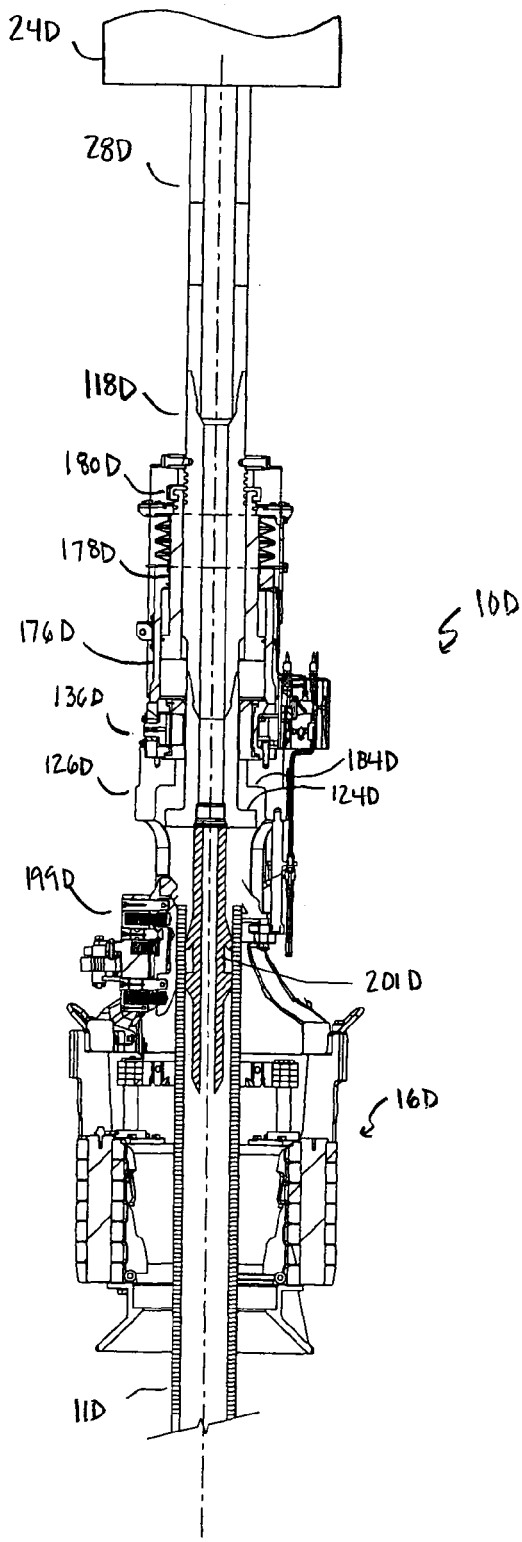
FIG. 11 is a side view, shown partially in cross-section, of a pipe running tool according to yet another embodiment of the invention.

FIG. 11 shows a pipe running tool 10D having an external gripping pipe engagement assembly 16D for gripping the external diameter of a pipe segment 10D, however, the pipe running tool of FIG. 11 does not include the links 40 and 40C as shown in the embodiments FIGS. 2 and 10, respectively. In stead, the pipe running tool 10D of FIG. 11 includes a primary load path, described below, wherein the primary load of the pipe running tool 10D and any pipe segments 11D and/or pipe strings is supported by, i.e. hangs directly from the threads on the output shaft 28D of the top drive assembly 24D. This allows the pipe running tool 10D to be a more streamlined and compact tool.

The external gripping pipe engagement assembly 16D of FIG. 11 includes substantially the same elements and functions as described above with respect to the pipe engagement assembly 16 of FIGS. 2-5B and therefore will not be described herein to avoid duplicity, except where explicitly stated below.

The embodiment of FIG. 11 shows a top drive assembly 24D having an output shaft 122D connected to a top drive extension shaft 118D on the pipe running tool 10D. A lower end of the top drive extension shaft 118D is externally splined allowing for a vertical movement, but not a rotationally movement, of the extension shaft 118D with respect to an internally splined ring 136D, within which the splined lower end of the top drive extension shaft 118D is received.

A load compensator 178D is connected to the top drive extension shaft 118D by a keeper 180D. The load compensator 178D is disposed within and is vertically moveable with respect to a load compensator housing 176D, as described above with respect to the load compensators of FIGS. 8 and 10 . The load compensator housing 176D is connected to the splined ring 136D, which is further connected to an upper portion of a lift cylinder housing 126D.

Attached to a lower end of the extension shaft 118D is a lift cylinder 124D. When the top drive assembly 24D is lifted upwards, the lift cylinder 124D abuts a shoulder 184D of the lift cylinder housing 126D to carry the weight of the pipe engagement assembly 16D and any pipe segments 11D and/or pipe strings held by the pipe engagement assembly 16D. A lower end of the lift cylinder housing 126D is connected to an upper end of the pipe engagement assembly 16D by a connector 199D.

Connected to a lower end of the lift cylinder 124D is a fill-up and circulation tool 201D (a FAC tool 201D), which sealingly engages an internal diameter of the pipe segment 11D. The FAC tool 210D allows a drilling fluid to flow through internal passageways in the extension shaft 118D, the lift cylinder 124D and the FAC tool 210D and into the internal diameter of the pipe segment 11D.

While several forms of the present invention have been illustrated and described, it will be apparent to those of ordinary skill in the art that various modifications and improvements can be made without departing from the spirit and scope of the invention. Accordingly, it is not intended that the invention be limited, except as by the appended claims.

What is claimed is:

1. A system for coupling a pipe segment to a pipe string comprising:

a top drive assembly having a threaded output shaft; and a pipe running tool;

wherein an upper end of the pipe running tool comprises an extension shaft threadingly coupled to the threaded output shaft of the top drive assembly such that the primary load of the pipe running tool is supported by the threads of the output shaft of the top drive assembly, wherein the pipe running tool is rotatable by the output shaft and wherein a lower end of the pipe running tool further comprises a pipe engaging portion for grippingly engaging the pipe segment sufficient to transmit a torque from the top drive output shaft to the pipe segment, wherein the weight of the pipe string is carried by the extension shaft of the pipe running tool, and wherein the extension shaft is connected to the pipe engaging portion by a shoulder abutting connection that is below the extension shaft and above the pipe engaging portion.

2. The system of claim 1, wherein the pipe engaging portion grippingly engages an external diameter of the pipe segment.

3. The system of claim 2, wherein the pipe engaging portion comprises a housing with a central opening for receiving the pipe segment and a plurality of slips moveable between a disengaged position and an engaged position wherein the slips grippingly engage the external diameter of the pipe segment.

4. A system for coupling a pipe segment to a pipe string comprising:

a top drive assembly having a threaded output shaft; and a pipe running tool;

wherein an upper end of the pipe running tool comprises an extension shaft threadingly coupled to the threaded output shaft of the top drive assembly such that the primaxy load of the pipe running tool is supported by the threads of the output shaft of the top drive assembly, wherein the pipe running tool is rotatable by the output shaft and wherein a lower end of the pipe running tool further comprises a pipe engaging portion for grippingly engaging the pipe segment sufficient to transmit a torque from the top drive output shaft to the pipe segment, wherein the weight of the pipe string is carried by the extension shaft of the pipe running tool, and wherein a lower end of the extension shaft comprises a lift cylinder that abuts a shoulder of a lift cylinder housing, which is threadingly coupled to the pipe engaging portion.

5. The system of claim 4, wherein the pipe engaging portion grippingly engages an internal diameter of the pipe segment.

6. The system of claim 5, wherein the pipe engaging portion comprises a tapered slip cone section which slidably receives corresponding tapered surfaces of a plurality of slips, such that a vertical force on the slips causes the slips to move radially outwardly into gripping engagement with the internal diameter of the pipe segment.

7. The system of claim 6, wherein the vertical force applied to the slips is sufficient to allow the gripping engagement of the slips with the internal diameter of the pipe segment to transmit a torque from the top drive output shaft to the pipe segment 8. The system of claim 7, wherein a slip cylinder applies the vertical force to each of the plurality of slips.

9. The system of claim 8, wherein the slip cylinder comprises a head portion, a shaft portion, and a plurality of feet attached to the shaft portion, wherein each foot is attached to a corresponding one of the slips.

10. The system of claim 9, wherein the slip cone section comprises a first tapered section and a second tapered section separated by a radially inward step, and wherein each of the plurality of slips comprises a first tapered section and a second tapered section separated by a radially inward step.

11. A system for coupling a pipe segment to a pipe string comprising:

a top drive assembly having an output shaft with threads; and a pipe running tool comprising an extension shaft at an upper end of the pipe running tool, a pipe engaging portion at a lower end of the pipe running tool, and a lift cylinder housing coupled to a top end of the pipe engaging portion, wherein the extension shaft is threadingly coupled to the output shaft such that a primary load of the pipe running tool is supported by the threads of the output shaft and such that the pipe running tool is rotatable by the output shaft, wherein the pipe engaging portion comprises a plurality of slips capable of grippingly engaging the pipe segment to transmit a torque from the top drive output shaft to the pipe segment, and wherein the lift cylinder housing comprises a lift cylinder that is movable to abut a load shoulder to support a primary load of the pipe string.

12. The system of claim 11, wherein the pipe engaging portion grippingly engages an external diameter of the pipe segment.

13. The system of claim 11, wherein the pipe engaging portion grippingly engages an internal diameter of the pipe segment.

14. The system of claim 11, wherein the pipe engaging portion comprises a tapered slip cone section which slidably receives corresponding tapered surfaces of the plurality of slips, such that a vertical force on the slips causes the slips to move radially outwardly into gripping engagement with an internal diameter of the pipe segment.

15. The system of claim 11, further comprising a compensator for vertically displacing the pipe segment relative to the top drive assembly.

* * * * *

UNITED STATES PATENT AND TRADEMARK OFFICE

CERTIFICATE OF CORRECTION

PATENT NO. : 7,699,121 B2
APPLICATION NO. : 11/165661
DATED : April 20, 2010
INVENTOR(S) : Daniel Juhasz et al.

It is certified that error appears in the above-identified patent and that said Letters Patent is hereby corrected as shown below:

In the Specifications:

| | |
|---|---|
| Column 5, line 33 | Delete "maybe" and insert -- may be -- |
| Column 8, line 36 | Delete "a" |
| Column 8, line 42 | Delete "show" and insert -- shown -- |
| Column 8, line 60 | Delete "may" |
| Column 8, line 65 | Delete "rotationally" and insert -- rotational -- |
| Column 9, line 24 | Delete "maybe" and insert -- may be -- |
| Column 9, line 42 | Delete first occurrence "includes a" |
| Column 12, line 39 | Delete "rotationally" and insert -- rotational -- |
| Column 12, line 52 | Delete "11 8C" and insert --118C -- |
| Column 13, line 28 | Delete "rig" and insert -- ring -- |
| Column 13, line 33 | Delete "mid-stoke" and insert -- mid-stroke -- |
| Column 13, line 48 | Delete "11 8C" and insert -- 118C -- |
| Column 13, line 57 | Delete "10D" and insert -- 11D -- |

Signed and Sealed this
Eighteenth Day of January, 2011

David J. Kappos

David J. Kappos
*Director of the United States Patent and Trademark Office*

| | |
|---|---|
| Column 14, line 11 | Delete “rotationally” insert -- rotational -- |

<u>In the Claims:</u>

| | |
|---|---|
| Column 15, Claim 4, line 16 | Delete “primaxy”<br>Insert -- primary -- |
| Column 15, Claim 7, line 43 | After “segment”<br>Insert -- . -- |